United States Patent [19]

Curington

[11] 3,958,645

[45] May 25, 1976

[54] BORE HOLE AIR HAMMER

[75] Inventor: Alfred R. Curington, Spartanburg, S.C.

[73] Assignee: Bakerdrill, Inc., Spartanburg, S.C.

[22] Filed: Feb. 11, 1974

[21] Appl. No.: 440,960

Related U.S. Application Data

[63] Continuation-in-part of Ser. No. 246,837, April 24, 1972.

[52] U.S. Cl. ..... 173/17; 173/73; 173/78; 173/80

[51] Int. Cl.[2] ..... E21B 5/00; E21C 7/00

[58] Field of Search ..... 173/17, 64–73, 173/78, 80, 135, 136

[56] References Cited

UNITED STATES PATENTS

| | | | |
|---|---|---|---|
| 1,518,124 | 12/1924 | Mercer | 173/78 X |
| 3,085,555 | 4/1963 | Morrison | 173/78 X |
| 3,198,264 | 8/1965 | Oelke et al. | 173/78 X |
| 3,503,459 | 3/1970 | Schindler | 173/136 X |
| 3,756,328 | 9/1973 | Sodnishnikov | 173/91 |
| 3,826,316 | 7/1974 | Bassinger | 173/73 |

*Primary Examiner*—Frank L. Abbott
*Assistant Examiner*—William F. Pate III
*Attorney, Agent, or Firm*—Bernard Kriegel

[57] ABSTRACT

An air hammer embodying an outer housing structure connectible to a rotatable drill pipe string through which compressed air is conducted. A hammer piston reciprocates in the housing structure along flexible inlet and outlet tubes, compressed air being directed alternately to the upper and lower ends of the piston to effect its reciprocation in the structure, each downward stroke inflicting an impact blow upon the anvil portion of an anvil bit extending upwardly within the lower portion of the housing structure. The piston contacts the housing structure at the upper and lower portions of the piston only, so that the piston can deviate upon flexing of the housing structure under load, and not bind in the housing structure, as permitted by the flexible inlet and outlet tubes. Excess compressed air is permitted to bypass through an orifice in the piston itself, to assist in cleaning the bore hole of cuttings and to avoid excess back pressure in the tool above the piston, resulting from the excess air delivered by the air compressor.

13 Claims, 8 Drawing Figures

BORE HOLE AIR HAMMER

Figure 1A:
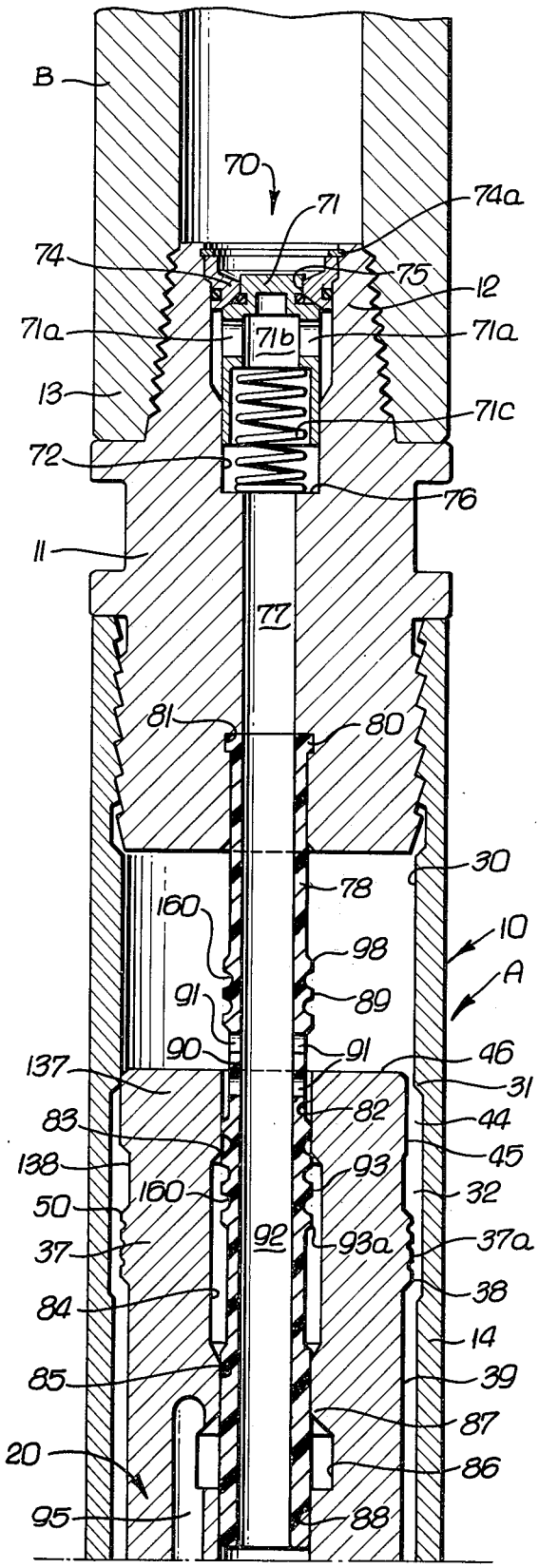

This application is a continuation-in-part of application Ser. No. 246,837, filed Apr. 24, 1972, for "Bore Hole Air Hammer."

The present invention relates to apparatus for drilling a bore hole in a formation, and more particularly to a pneumatically operated apparatus that imparts a percussive action to a drill bit while the latter is preferably being rotated, in order that the bit may cover substantially the full area of the bore hole bottom.

Prior air hammers include a hammer piston reciprocating in a housing structure to impart repeated impact blows to an anvil, integral with a drill bit, to drill a bore hole. The housing structure is secured to a string of drill pipe through which required drilling weight is imposed on the drill bit and through which the air hammer and bit are rotated to insure a drilling action on substantially the entire area of the bottom of the bore hole. Prior air hammers have a large contact area between the hammer piston and wall of the housing structure, which results in the piston binding in the housing structure upon flexing of the latter under stress. A hammer piston is known that has a relatively small contact area at its upper and lower portions with the housing structure, but binding still occurs when the housing structure flexes under stress since the piston is prevented from deviating laterally by a rigid and close fitting air tube extending through the piston.

In the present case, the binding tendency of the piston in the housing structure is minimized by providing minimum engagement between the upper and lower end portions of the piston with the wall of the housing structure, and by providing one or more flexible or elastic air tubes extending into the piston along which the piston is reciprocable. The piston is free from contact with the housing wall between its upper and lower end portions. As a result, stresses imposed upon the housing structure of a magnitude that cause it to flex do not produce binding of the piston in the housing structure, since the piston can deviate or shift laterally and follow along the deviated path of the flexed housing wall, as permitted by the elastic or flexible tube or tubes.

In some prior air hammers, bypass chokes have been used to bypass a surplus volume of air supplied by the air compressor with respect to the hammer piston, so that the compressor can operate more efficiently, all of the air still being available for maximum cleaning of the bore hole. Prior bypass choke locations still result in part of the excess air discharging from the choke into the upper portion of the housing structure above the piston, thereby increasing the back pressure of the air above the piston as it is moving on its return stroke, adversely affecting performance of the air hammer.

In the present application, the bypass choke is mounted within a passage extending through the hammer piston itself, the air discharging from the choke directly toward and into the exhaust passages through the drill bit. As a result, the back pressure in the housing chamber above the piston is not increased, as the piston moves on its return stroke, since none of the bypassed air can discharge into such chamber.

This invention possesses many other advantages, and has other purposes which may be made more clearly apparent from a consideration of a form in which it may be embodied. This form is shown in the drawings accompanying and forming part of the present specification. It will now be described in detail, for the purpose of illustrating the general principles of the invention; but it is to be understood that such detailed description is not to be taken in a limiting sense.

Figure 1B:
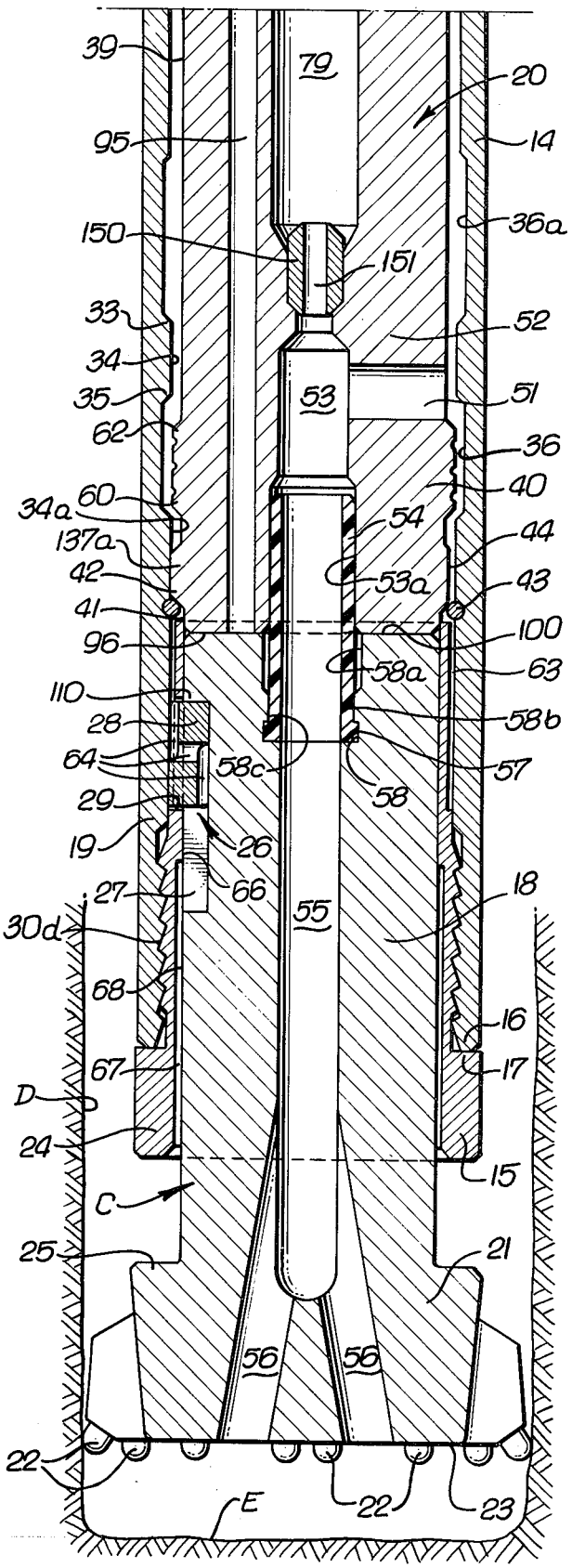

Referring to the drawings:

FIGS. 1*a* and 1*b* together constitute a longitudinal section through an apparatus embodying the invention, with parts in their relative positions in which the drill bit has been elevated from the bottom of the hole, allowing air to be circulated through the apparatus, FIG. 1*b* being a lower continuation of FIG. 1*a;*

Figure 3:
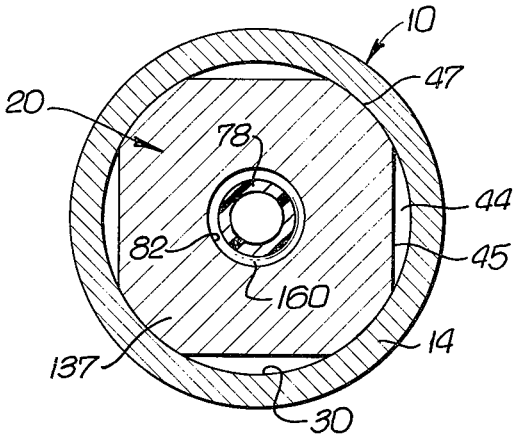
Figure 2A:
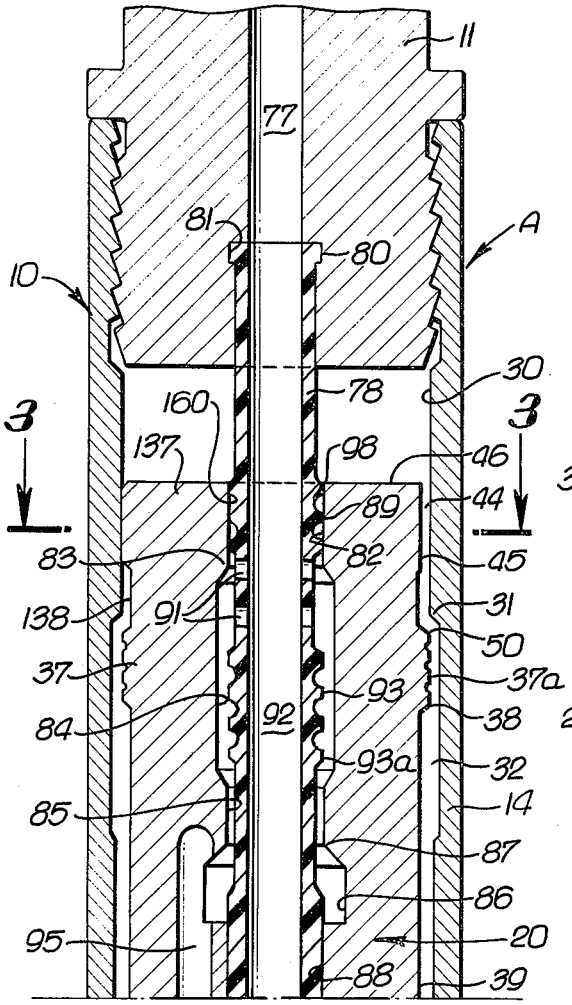
Figure 2B:
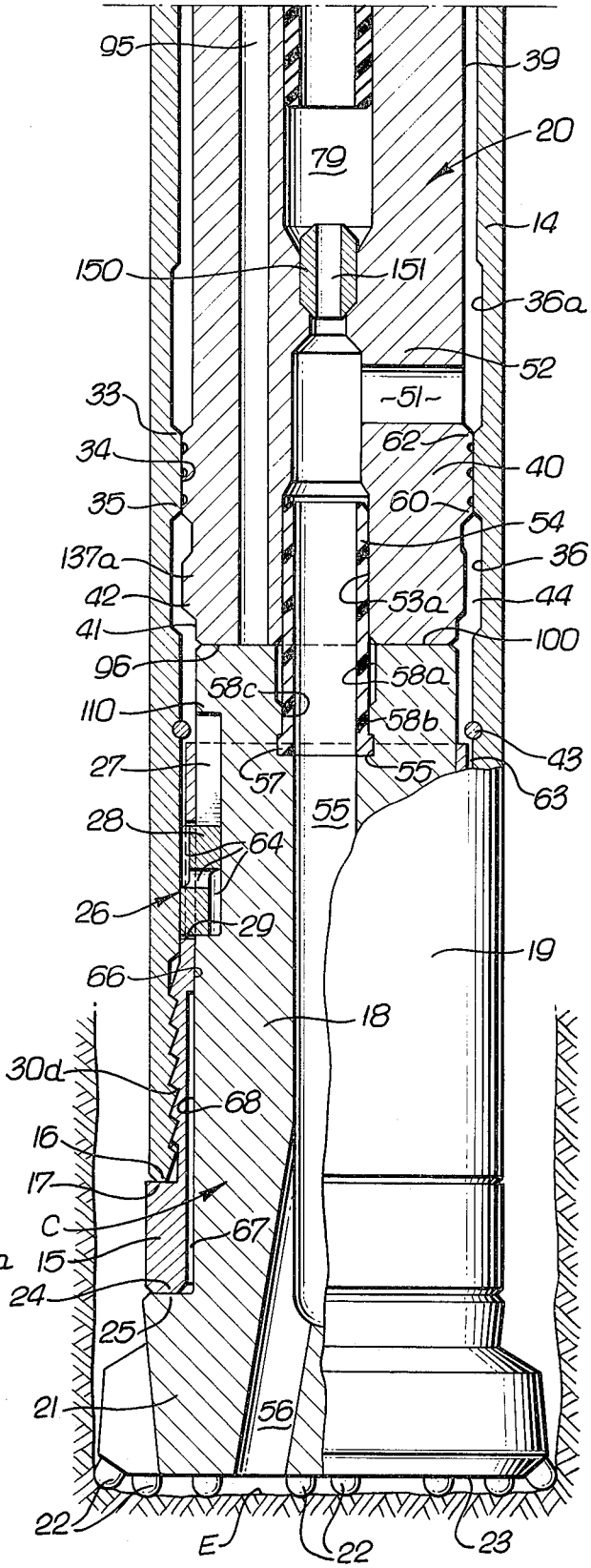

FIGS. 2*a* and 2*b* are views similar to FIGS. 1*a* and 1*b*, with parts in their relative positions in which the hammer piston has completed delivering an impact blow against the companion anvil bit, FIG. 2*b* being a lower continuation of FIG. 2*a*;

FIG. 3 is a cross-section taken along the line 3—3 on FIG. 2*a;*

Figure 5:
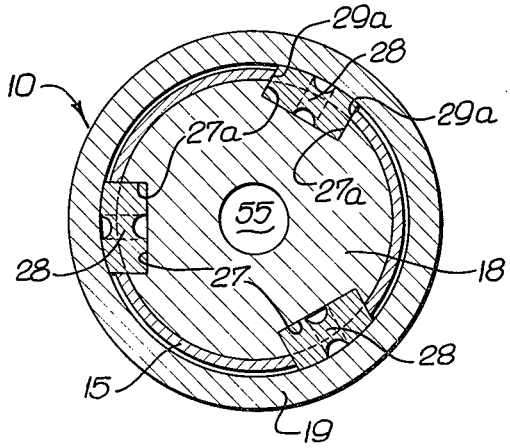
Figure 4B:
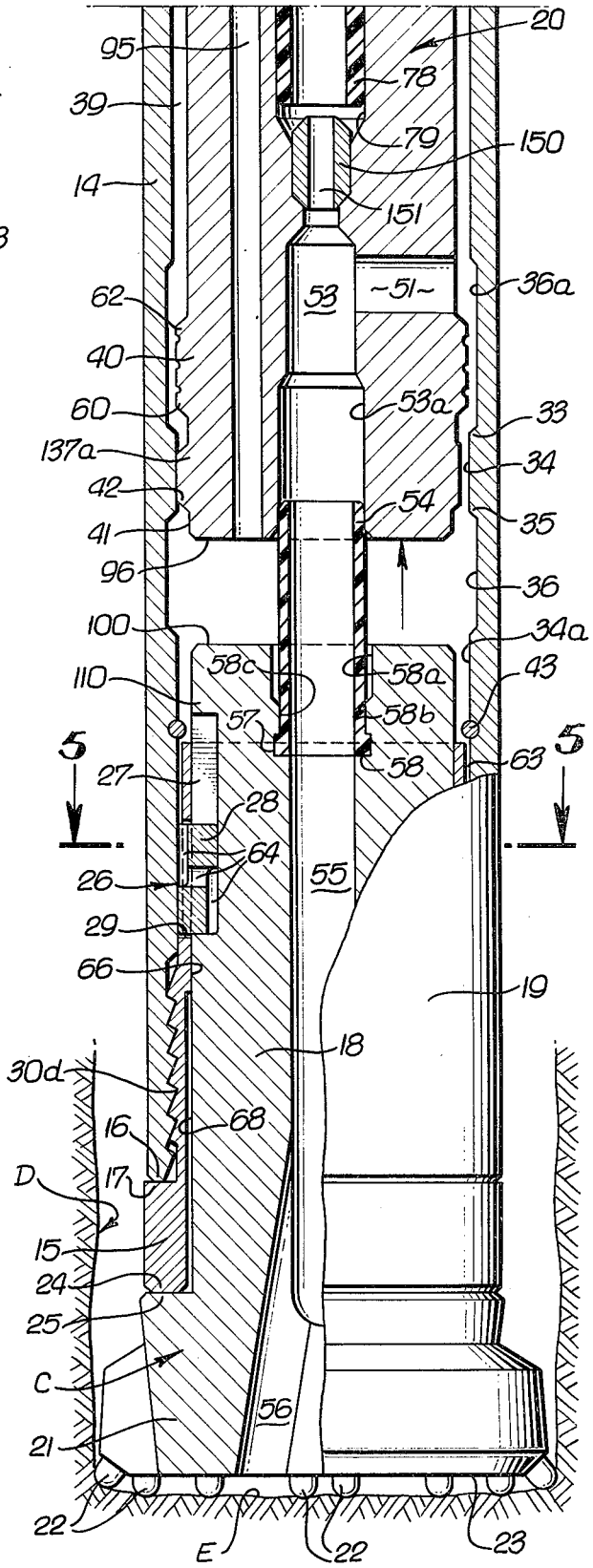
Figure 4A:
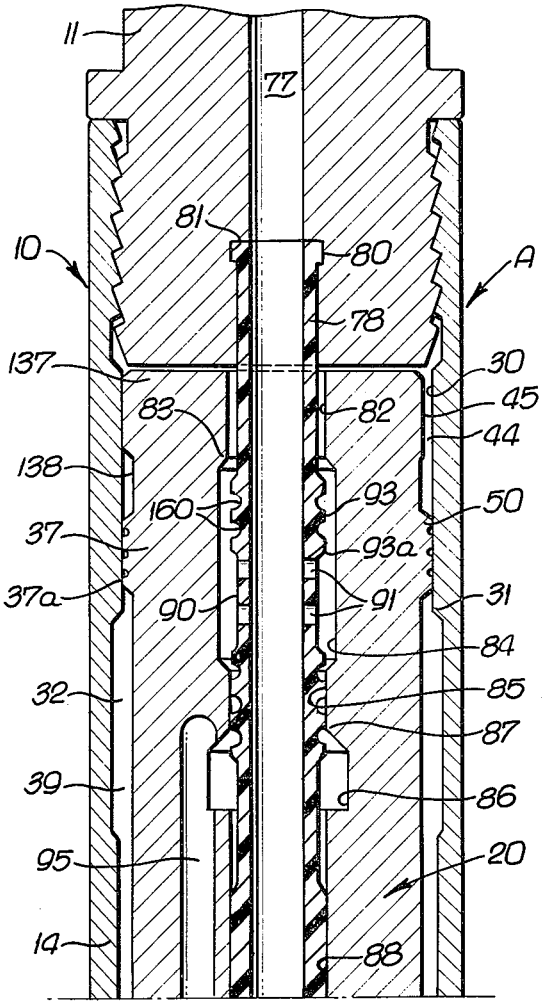

FIGS. 4*a* and 4*b* are views similar to FIGS. 1*a* and 1*b*, with the hammer piston approaching its upper position, FIG. 4*b* being a lower continuation of FIG. 4*a;* and FIG. 5 is a cross-section taken along the line 5—5 on FIG. 4*b*.

As shown in the drawings, an air hammer apparatus A is provided that is secured to the lower end of a string of drill pipe B, by means of which the apparatus is rotated to correspondingly rotate an impact anvil bit C used for drilling a bore hole D, the apparatus delivering repeated impact blows upon the anvil bit by forcing compressed air down the drill pipe for actuating the apparatus and for cleaning the cuttings from the bottom E of the hole. The apparatus is relatively simple, consisting of an elongate housing structure 10 that includes an upper sub 11 having an upper threaded pin 12 for threaded attachment to the lower end 13 of the string of drill pipe, that extends to the drilling rig (not shown) at the top of the bore hole D. This sub is threadedly secured to the upper portion of an elongate housing section 14, which can be of one piece, the lower end of which is threadedly secured to a lower housing head or drive member 15, the lower end 16 of the housing section bearing against an upwardly facing shoulder 17 formed on the head.

An elongate anvil portion 18 of the anvil bit C is piloted upwardly within the drive member 15 and lower portion 19 of the housing section 14, a hammer piston 20 being reciprocable in the housing section above the anvil 18 to deliver repeated impact blows thereagainst. The anvil is preferably formed integrally with the drill bit portion 21 of the anvil bit, which has suitable cutting elements 22 (such as sintered carbide buttons) mounted in its drilling face 23 for impacting against the bottom E of the bore hole, to produce cuttings therein, the cutting elements 22 also acting against the side of the bore hole adjacent to its bottom to insure the production of a bore hole D of the desired diameter.

During the reciprocation of the hammer piston 20 in the housing to deliver impact blows upon the anvil bit, the drill pipe string B and housing structure 10 are rotated at a desired speed, such as 10 to 20 r.p.m., to correspondingly rotate the anvil bit C and insure an impacting action of the cutting members 22 over substantially the entire cross-sectional area of the bottom E of the hole. During the impacting action, suitable drilling weight is imposed on the anvil bit through the drill pipe string B and the housing structure 10, such drilling weight being transferred from the lower end 24 of the housing head or drive member 15 to an upwardly facing shoulder 25 of the bit 21. The rotary drive itself is transferred from the housing structure 10 to the anvil 18 through a slidable spline type of connection 26, which can assume several different forms, the particular drive connection illustrated constituting no portion of the present invention. Substantially the same drive connection is illustrated in the application of Alfred R. Curington, for "Rotary Bore Hole Air Hammer Drive Mechanism", Ser. No. 392,076, filed Aug. 27, 1973, to which attention is directed.

In general, the upper portion of the anvil has circumferentially spaced elongate grooves 27 (FIG. 5), in which segments 28 are disposed, these segments being carried in circumferentially spaced windows 29 in the drive member 15. The grooves 27 are substantially longer than the length of the segments 28, permitting relative longitudinal movement of the anvil bit C with respect to the housing structure 10. The rotary effort is transferred from the housing section 14 to the drive member 15 by virtue of the threaded connection 30*d*, and from the sides 29*a* of the openings 29 to the segments 28, from where the turning effort is transmitted through the segments 28 and groove sides 27*a* to the anvil bit C.

The housing section 14 includes an upper inner cylindrical housing wall 30, the lower end 31 of which constitutes an upper housing flow control corner at the upper end of an elongate internal circumferential exhaust groove 32 of a substantially larger internal diameter than the diameter of the inner cylindrical housing wall 30. Disposed substantially below the lower end 33 of the exhaust groove, the housing section is provided with a lower inner cylindrical housing wall 34, which may be of the same internal diameter as the upper housing wall 30, the upper end of the lower wall being the housing lower flow control corner 33. The lower end 35 of the lower inner cylindrical housing wall 34 provides a bypass corner at the upper end of an enlarged internal diameter circumferential bypass groove 36. Similarly, the housing has an enlarged internal diameter circumferential bypass groove 36*a* immediately above the lower corner 33.

The elongate hammer piston 20 includes an upper piston portion 37 having an external diameter 37*a* conforming to the diameter of the upper inner cylindrical housing wall 30, this upper piston portion terminating at the upper end 38 of an elongate external circumferential exhaust groove 39 or piston relief portion of a lesser external diameter than the upper piston portion 37. This external exhaust groove terminates at a lower piston portion 40 having an external diameter conforming to the internal diameter of the lower inner cylindrical housing wall 34. Below its lower piston portion, the hammer is of a reduced external diameter 41, providing a downwardly facing shoulder 42 which may, upon removal of the anvil bit C from the housing 10, engage a limit ring 43 mounted in the housing section 14, to prevent the piston 20 from inadvertently dropping out of the housing structure. The hammer piston has an upper guide portion 137 separated by a circumferential groove 138 from the upper piston portion 37. This upper guide portion has a plurality of circumferentially spaced relief portions 44 (FIG. 3) which may be formed by chords 45 extending from the upper end of the groove 138 to the upper end 46 of the guide portion 137, there being circumferentially spaced elongate arcuate sections 47 between the relief portions 44 having the same external diameter as the upper piston portion 37 and assisting in guiding the hammer piston 20 in its reciprocation along the inner wall of the housing section 14.

As described hereinbelow, when the hammer piston 20 is at the lower end of its stroke, as shown in FIGS. 2*a*, 2*b*, a flow control piston corner 50 at the upper end of the piston portion 37 is spaced below the upper housing flow control corner 31, allowing air in the housing above the piston 20 to flow down through the passages 44 and into the internal circumferential exhaust groove 32, around the upper piston portion 37, then through the lower portion of the groove 32 and the grooves 39 and 36*a* into radial exhaust ports 51, formed through the hammer piston below its intermediate piston wall 52, that communicate with an elongate central piston cavity 53 into which an exhaust tube 54 extends upwardly from the anvil 18, the tube forming a continuation of the exhaust passage 53 and communicating with an exhaust passage 55 through the anvil and one or a plurality of exhaust passages 56 extending downwardly through the bit 21 and opening outwardly thereof for the purpose of removing the cuttings from the bottom E of the hole. The tube 54 makes a slidable seal with the wall 53 *a* of the piston cavity 53, being secured to the anvil 18 by a lower outwardly extending tube flange 57 being received within an inner circumferential groove 58 in the anvil. The tube may be made of an elastic material, such as Delrin, which permits it to be inserted within the anvil passage, the flange 57 contracting sufficiently until it is opposite the circumferential groove 58, whereupon the tube flange can snap outwardly into the groove 58 and thereby lock the tube 54 to the anvil 18.

When the piston 20 is shifted upwardly within the housing on its return stroke, the return air corner 60 at the lower end of the lower piston portion 40 will be disposed above the housing lower flow control corner 33 (FIGS. 4*a*, 4*b*), whereupon the compressed air below the piston can exhaust into the internal circumferential housing groove 36*a* and flow through the exhaust ports 51 and exhaust passages 53, 55, 56 to the bottom E of the bore hole. At this time, the upper flow control piston corner 50 will be disposed above the upper housing flow control corner 31, which will seal the upper piston portion 37 against the upper inner cylindrical housing wall 30, whereupon compressed air can drive the piston 20 downwardly on its hammer or power stroke. When the return air corner 60 moves below the housing lower flow control corner 33, the air below the piston and within the housing, which remains after the lower piston portion 40 is closed within the lower end of the cylindrical housing wall 34, is subject to compression, but such air will be at a relatively low pressure.

As described hereinbelow, in the event the apparatus is elevated to raise the bit 21 from the bottom E of the hole, the latter will drop downwardly until its upper anvil head shoulder 110 engages the upper ends of the segments or keys 28. This will allow the upper piston bypass corner 62 of the lower piston portion 40 to shift below the housing bypass corner 35 at the lower end of the lower inner cylindrical housing wall 34, the upper flow control piston corner being well below the upper housing flow control corner (FIGS. 1*a*, 1*b*). Accordingly, compressed air above the piston can flow through the passages 44 and the circumferential exhaust grooves 32, 39, 36*a* into the air bypass groove 36 below the lower housing wall 34, the air passing downwardly through the passage 63 in the upper portion of the anvil rotary drive member 15 and into the bypass passages 64 in the segments 28 into the grooves 27 in the anvil 18, the air flowing past a head sealing portion 66 within the drive member 15 and into elongate relief grooves 67 extending downwardly through the lower end of the drive member 15. When the anvil 18 is in its upper position within the housing and with the bit shoulder 25 engaging the lower end 24 of the drive member 15, the head sealing portion 66 seals against the periphery 68 of the anvil below its elongate grooves 27 in which the segments or keys 28 are positioned.

Compressed air for reciprocating the hammer piston 20 passes downwardly through the string of drill pipe B and into the upper housing sub 11, flowing past a downwardly opening check valve 70 which may be in the form of a valve head 71 slidable within a valve counterbore 72 in the sub, the head being movable upwardly to engage a companion seat 74 surrounding a central passage 75 through the seat, the downward movement of the valve head being limited by its engagement with the base 76 of the counterbore. With air being pumped downwardly through the apparatus, the head 71 is shifted downwardly from the seat, around the upper portion of the head, and through head ports 71*a* into a central passage 71*b* of the head and into a central passage 77 in the housing sub 11. The seat is held in place by a snap retainer ring 74*a* secured to the sub, a spring 71*c* urging the valve head upwardly into engagement with the seat.

The inlet air under pressure is caused to flow alternately into the housing below the piston 20 and the housing above the piston, to effect reciprocation of the hammer piston. A housing inlet tube 78 is mounted in the sub passage 77, projecting downwardly from the sub or head 11 and into an upper elongate central piston cavity or chamber 79 above the intermediate piston wall 52, which separates the upper chamber 79 from the lower chamber 53. An orifice member 150 having an orifice 151 may be press-fit in the wall 52. The tube 78 is secured in the sub by an upper external flange 80 on the tube fitting within a companion internal circumferential groove 81 in the sub. The inlet tube is made of a flexible material, such as Delrin, which permits the upper portion of the tube to be deflected inwardly of the sub passage 77 below the circumferential groove 81, and when the flange 80 becomes aligned with the groove, the flange inherently expands outwardly into the groove to secure the tube to the sub 11. The elastic nature of the tube is such that it also provides a slidable seal with the inner walls of the piston 20, as explained hereinbelow.

The piston has an elongate upper cylindrical surface 82 opening through its upper end 46 and terminating at an inner, upper flow control piston corner 83, which is the upper end portion of an elongate internal circumferential impact passage groove 84 having a substantially larger internal diameter than the inside diameter of the upper piston portion surface 82. The circumferential impact passage groove 84 terminates at an intermediate inner cylindrical piston wall 85, which may have the same internal diameter as the upper cylindrical piston wall 82, the intermediate wall terminating at an internal circumferential return passage groove 86 formed in the piston and terminating at a lower flow control piston corner 87, which is the upper end of a lower internal piston seal portion 88 that extends upwardly from the intermediate piston wall 52. The inlet tube 78 has an upper external cylindrical sealing surface 89 relatively slidably sealable with the upper piston wall 82 and terminating in an external circumferential inlet groove 90 communicating with radial inlet ports 91 that open to the central inlet passage 92 through the tube. Below this circumferential inlet groove 90, the tube is formed as a lower cylindrical sealing surface 93 slidably and sealingly engageable with the intermediate inner cylindrical piston wall 85 and also with the lower piston wall 88. Labyrinth grooves 160 are provided in the tube surfaces 89 and 93 to enhance the sealing effectiveness of the surfaces 89, 93 with the walls 82, 85.

When the piston 20 is in its lowermost operative position, with the drill bit 21 pressed against the bottom E of the bore hole D, compressed air can flow downwardly through the inlet passage 92, discharging into the circumferential return passage 86 that communicates with the upper portion of one or more longitudinal return passages 95 extending downwardly through the hammer piston and opening outwardly through its lower end 96. When the hammer piston 20 moves upwardly within the housing 10 and along the inlet tube 78, the lower flow control piston corner 87 first shifts upwardly over the flow control housing tube corner 93*a* to disrupt communication between the inlet passage 92 and the return passages 95, continued upward movement of the piston then placing the inner upper flow control piston corner 83 above the upper flow control housing tube corner 98, which then allows compresssed air to flow from the inlet passage 92 through the ports 91 into the circumferential inlet groove 90 into the internal circumferential impact passage groove 84 and thence into the housing above the upper end 46 of the piston (FIGS. 4*a*, 4*b*). At this time, the upper piston corner 50 will have moved partially above the upper housing flow control corner 31, so that the air under pressure between the upper end 46 of the piston and the housing sub or head 11 can act downwardly on the piston, urging it in a downward direction.

The piston 20 will be shifted downwardly until the upper flow control piston corner 83 moves below the flow control housing tube corner 98, which shuts off air pressure into the housing above the piston, the piston continuing to move downwardly, as the compressed air expands, until the outer upper flow control piston corner 50 moves below the upper housing flow control corner 31, which then permits air above the piston to pass through the passages 44 into the circumferential exhaust grooves 32, 39, 36*a* and through the exhaust ports 51 and exhaust passages 53, 55, 56 to the bottom of the hole below the drill bit, the hammer piston being driven against the upper face 100 of the anvil to deliver an impact blow to the impact bit C. As the piston nears the end of its downward stroke, the lower flow control piston corner 87 will move below the lower flow control housing tube corner 93*a*, thereby allowing the compressed air to flow from the inlet passage 92 through the ports 90 into the groove 84, flowing through the annular passage between the tube and wall 85 into the return passage groove 86, passing downwardly through the longitudinal return passages 95 to the lower end of the piston, such air then moving the piston in an upward direction, until the lower flow control piston corner 87 passes upwardly beyond the lower flow control housing tube corner 93*a* once again, to shut off the flow of air into the return passages 95. When this occurs, the outer upper flow control piston corner 50 moves above the upper housing flow control corner 31 to shut off the exhaust of air from the housing region above the piston 20, the compressed air below the piston expanding and driving the hammer piston upwardly toward the head 11 of the housing. Before reaching the head 11, the inner upper flow control piston corner 83 will have shifted upwardly along the tube 78 to a position above the upper flow control housing tube corner 98, allowing air under pressure to pass from the inlet passage 92 through the impact passage grooves 90, 84 to a position in the housing above the piston 20.

The upward travel of the piston 20 is cushioned by the compression of the air remaining in the housing above the piston. However, the piston will still move upwardly sufficiently to place the lower corner 60 of the lower piston portion 40 above the housing lower flow control corner 33, which then permits the compressed air below the piston to travel into the internal circumferential exhaust groove 32 and through the exhaust ports 51 into the exhaust passages 53, 55, 56 for discharge from the drill bit. The compressed air in the housing structure above the piston then expands to drive the piston downwardly, and the foregoing cycle of operation is repeated, the piston reciprocating to deliver repeated impact blows against the anvil portion 18 of the anvil bit C, while the drill string B and the entire apparatus A is being rotated, to insure that the drilling or cutting elements 22 will cover substantially the entire cross-sectional area of the bore hole bottom E.

The hammer piston also has a lower guide portion 137*a* spaced downwardly from the lower piston portion 40 and slidable along the walls 34 and 34*a* below the groove 36 when the piston is approaching or is at its uppermost and lowermost positions. The lower guide also has the same relief portions 44 as the upper guide 137.

In the event it is desired to pump compressed air through the apparatus while the drill bit 21 is off bottom, elevation of the apparatus A will cause the impact bit C to drop downwardly along the housing until the upper anvil head 110 engages the upper ends of the keys 28 (FIGS. 1*a*, 1*b*). The piston 20 will also drop downwardly until its bypass corner 62 is below the bypass corner 35 of the housing 10, the upper corner 62 of the piston being disposed below the upper end of the internal circumferential groove 36. Accordingly, compressed air flowing downwardly through the drill string B and into the inlet passage 92 can pass through the inlet ports 91 and upwardly to a position above the piston, then flowing downwardly through the upper passages 44 and into the internal circumferential exhaust groove 32, flowing between the external circumferential exhaust groove 39 in the piston and the opposed lower inner cylindrical housing wall 34 into the enlarged diameter groove 36 below the inner cylindrical housing wall, then passing through the lower passages 44 in the lower guide 137*a* and through the passages 63, 64, 27, 67 to the exterior of the bit 21. The major portion of the compressed air will flow around the upper piston 37 through the grooves 32, 36*a*, ports 51 and passages 53, 55, 56 to the exterior of the bit 21, to clean the bore hole D of cuttings.

As described above, the exhaust tube or sleeve 54 is made of an elastic material, which is a suitable synthetic resin such as Delrin. This sleeve must make a slidable seal with the wall 53*a* of the piston cavity 53 to prevent or minimize leakage of air between the tube and the wall 53*a*. Because of manufacturing tolerances, a perfect alignment between the hammer piston 20 and the anvil 18 may not exist. Accordingly, as the piston approaches the anvil and impacts thereagainst, it imposes a lateral force on the exhaust sleeve 54. If the exhaust tube made a close fit with the wall 58*c* of the anvil downwardly from its upper face 100, even a small amount of misalignment between the piston 20 and the anvil would cause a high shearing stress to be imposed on the exhaust tube 54, resulting in fatigue failure of the exhaust tube after a relatively short period of use of the apparatus.

The above difficulty is overcome in the apparatus illustrated by providing relief between the exterior of the exhaust tube or sleeve 54 and the wall 58*c* of the anvil 18, such relief extending downwardly from the upper anvil face 100. As shown, a counterbore 58*a* is provided in the anvil that extends downwardly from its upper face 100 to a substantial extent, which, by way of example, is of the order of about one inch. In view of the counterbore, any misalignment between the piston 20 and the anvil 18 will prevent the high shearing stresses from occurring on the tube substantially in the plane of the upper face 100 of the anvil. Instead, the exhaust sleeve 54 can readily flex or bend laterally about the base 58*b* of the counterbore, which acts as a fulcrum point, particularly in view of the elastic material from which the exhaust sleeve 54 is made. The bending stresses to which the tube 54 is subjected, as a result of misalignment between the piston 20 and the anvil 18, are maintained at a comparatively low value, which prevents the exhaust sleeve 54 from fatigue failure.

Although the counterbore 58a has been provided to permit the bending of the sleeve 54, a corresponding result can be achieved by maintaining the wall 58*c* of the anvil cylindrical from its upper face 100 downwardly, and by providing the relief in the exterior of the exhaust sleeve 54 itself. Thus, the outside diameter of the exhaust sleeve would be reduced slightly in a downward direction from substantially the plane of the upper face 100 to a substantial extent, which, as presented in the above example relating to the counterbore, would be of the order of about one inch. The high shearing stresses on the sleeve 54 substantially in the plane of the upper face 100 would be eliminated, the sleeve 54 being subjected to the relatively low bending stresses, as a result of misalignment, that might occur between the piston 20 and the anvil 18.

The inlet tube 78 is also made of an elastic material, such as Delrin. This sleeve has sufficient length below the lower end of the upper sub 11 as to be capable of flexing laterally of the axis of the air hammer at all positions of the piston 20 along the tube 78, thereby presenting the same advantages as the lower flexible or elastic sleeve 54.

As illustrated in the drawings, an orifice member 150 has been disposed in the intermediate piston wall 52 to permit excess air to flow through the inlet tube 78, chamber 79, the orifice 151, central piston cavity 53, exhaust tube 54, anvil passage 55, and its exhaust passages 56 into the well bore. The ability to bypass the volume of air directly to the bit through the choke member insures a maximum hole cleaning action without inhibiting the action of the compressed air on the hammer piston. The choke member is used when the volume of air at a desired unit pressure is much greater than that required to operate the hammer bit, the size of the choke being so selected that the surplus volume of air is permitted to pass directly through the bit. The use of the surplus volume of air for the purpose of cleaning the well bore of cuttings allows the high volume compressor to run at top efficiency. As the surplus volume of air available becomes greater, a larger size choke member 150 would be installed within the piston. When no excess volume of air is available, the choke orifice member 150 would be replaced by a blank member; that is, one having no orifice 151 through it, so that all of the air supplied by the compressor is available for reciprocating the piston within the housing.

It is further to be noted that the choke orifice member 150 is disposed above the radial exhaust ports 51. The exhaust from the choke orifice 151 flows past the radial ports 51 and tends to reduce the pressure therein, thereby assisting in the flow of exhaust air through the ports and through the passages 53, the tube 54 and the anvil passages 55, 56 into the bore hole.

In the hammer drill illustrated in the drawings, the upper and lower piston portions 37, 40 are at the end portions of the piston, being spaced longitudinally from one another by a substantial extent, these piston portions being separated by the elongate relief portion 39 which does not contact the wall of the hole. The upper and lower guide portions 137, 137*a* may contact the upper housing wall 30 and the lower walls 34, 34*a*, but such guide portions and their adjacent piston portions 37, 40 engage their respective housing walls over a relatively small extent. During the drilling operation, the drilling weight and torque imposed on the housing structure 10 causes its flexing, tending to create a binding action on the reciprocating piston 20. Such binding action is minimized by virtue of the minimum wall contact between the greatly longitudinally spaced upper and lower portions 37, 40 of the piston with the housing, and by the fact that the central inlet and exhaust tubes 78, 54 are made of flexible or elastic material. Accordingly, flexing of the housing is accompanied by a companion lateral movement or tilting of the piston 20, so that it can follow the deviations in the housing structure during its reciprocation in the latter. Such lateral shifting is permitted, since the inlet and exhaust tubes 78, 54, which are made of flexible or elastic material, can partake of a lateral or bending movement. If these tube members were made of rigid material, the piston could not shift laterally or tilt as a result of deflection of the housing structure 10, creating a binding action between the piston portions 37, 40 of the piston and the housing structure. In the absence of the extensive longitudinal spacing between the piston portions 37, 40 and the flexible tube members 78, 54, a binding action would occur. By virtue of the arrangement illustrated in the drawings, the ability of the piston 20 to shift or tilt as the housing deflects prevents excessive contact pressures between the piston and the housing wall, preventing galling of the parts and ultimate failure of one or more of them.

I claim:

1. Percussion drilling apparatus: comprising a housing structure having an inner wall and connectible to a drill string; an anvil in the lower portion of said housing structure and operatively connectible to a drill bit; a hammer piston reciprocable in said housing structure for intermittently impacting against said anvil; means for directing a fluid medium under pressure into said housing structure for action upon said piston to effect reciprocation of said piston in said housing structure; said piston having short upper and lower end sealing portions contacting the inner wall of said housing structure, said piston having upper and lower guide portions above and below said upper and lower end sealing portions, respectively, contacting the inner wall of said housing structure, said piston being relieved along its entire length between said end portions to be free from contact with said inner wall along the entire length of said piston between said end portions, the exterior of said piston being unsupported along its entire length between said end portions, said relieved length of said piston being substantially greater than the total of the wall contacting lengths of said end portions and guide portions; and piston having central passage means therein; flexible tubular means through which the fluid medium can flow extending into said passage means in relative slidable relation to said piston, said flexible tubular means being capable of being flexed by said piston to permit movement of said piston laterally of the normal axis of said housing structure.

2. Apparatus as defined in claim 1; said flexible tubular means comprising an upper flexible inlet tube secured to said housing structure and extending into the upper portion of said passage means and a lower flexible exhaust tube extending into the lower portion of said passage means and communicating with a passage in said anvil.

3. Apparatus as defined in claim 1; said flexible tubular means comprising an upper flexible inlet tube secured to said housing structure and extending into the upper portion of said passage means and a lower flexible exhaust tube extending into the lower portion of said passage means and communicating with a passage in said anvil; said piston having a choke orifice in said passage means between and communicating with said inlet and outlet tubes.

4. Apparatus as defined in claim 1; said flexible tubular means comprising an upper flexible inlet tube secured to said housing structure and extending into the upper portion of said passage means and a lower flexible exhaust tube secured to said anvil and extending into the lower portion of said passage means and communicating with a passage in said anvil.

5. Percussion drilling apparatus: comprising a housing structure connectible to a drill string; an anvil in the lower portion of said housing structure and operatively connectible to a drill bit; a hammer piston reciprocable in said housing structure for intermittently impacting against said anvil, said piston having an upper passage and a lower passage; flexible tubular inlet means relatively slidable in said upper passage for directing a fluent medium under pressure into said upper passage; first means for directing the fluid medium from said upper passage into said housing structure above said piston upon upward movement of said piston in said housing structure for driving said hammer piston downwardly toward said anvil; second means for directing the fluid medium from said upper passage into said housing structure below said piston upon downward movement of said piston in said housing structure for elevating said piston in said housing structure; means for alternately exhausting the fluid medium from the housing structure above and below said piston including flexible tubular exhaust means relatively slidable in said lower passage; said piston having short upper and lower end sealing portions contacting the inner wall of said housing structure, said piston being relieved along its entire length between said end portions to be free from contact with said housing wall, said relieved length of said piston being substantially greater than the total of the wall contacting lengths of said end portions; both of said flexible tubular means being capable of being flexed by said piston to permit movement of said piston longitudinally of the normal axis of said housing structure.

6. Apparatus as defined in claim 5; and means closing said piston between said upper and lower passages.

7. Apparatus as defined in claim 5; and a choke orifice in said piston between said upper and lower passages to restrict fluid flow therethrough from said upper passage to said lower passage.

8. Percussion drilling apparatus: comprising a housing structure connectible to a drill string; an anvil in the lower portion of said housing structure and operatively connectible to a drill bit; a hammer piston reciprocable in said housing structure for intermittently impacting against said anvil, said piston having a central upper chamber and a central lower chamber therein; a flexible inlet tube piloted in said upper chamber and adapted to receive a fluid medium under pressure from the drill string and direct such fluid medium into said chamber; first passage means for directing the fluid medium from said upper chamber into said housing structure above said piston; second passage means for directing the fluid medium from said upper chamber into said housing structure below said piston; coengaging valve means on said inlet tube and piston wall of said upper chamber opening said first passage means and closing said second passage means upon upward movement of said piston in said housing structure and closing said first passage means and opening said second passage means upon downward movement of said piston in said housing structure; means alternately exhausting the fluid medium from the housing structure above and below said piston including a flexible exhaust tube relatively slidable in said lower chamber; said piston having short upper and lower end sealing portions contacting the inner wall of said housing structure, said piston being relieved along its entire length between said end portions to be free from contact with said inner wall, said relieved length of said piston being substantially greater than the total of the wall contacting length of said end portions; both of said flexible tubes being capable of being flexed by said piston to permit movement of said piston laterally of the normal axis of said housing structure.

9. Apparatus as defined in claim 8; and means closing said piston between said upper and lower passages.

10. Apparatus as defined in claim 8; and a choke orifice in said piston between said upper and lower chambers to restrict flow of fluid therethrough from said upper chamber to said lower chamber.

11. Apparatus as defined in claim 8; and a choke orifice in said piston between said upper and lower chambers to restrict flow of fluid therethrough from said upper chamber to said lower chamber; said exhausting means further including a side port in said piston below and adjacent to said choke orifice establishing fluid communication between the exterior of said piston and said lower chamber.

12. Percussion drilling apparatus: comprising a housing structure connectible to a drill string; an anvil in the lower portion of said housing structure and operatively connectible to a drill bit; a hammer piston reciprocable in said housing structure for intermittently impacting against said anvil, said piston having an upper passage and a lower passage; tubular inlet means relatively slidable in said upper passage for directing a fluid medium under pressure into said upper passage; first means for directing the fluid medium from said upper passage into said housing structure above said piston upon upward movement of said piston in said housing structure for driving said piston downwardly toward said anvil; second means for directing the fluid medium from said upper passage into said housing structure below said piston upon downward movement of said piston in said housing structure for elevating said piston in said housing structure; means for alternately exhausting the fluid medium from the housing structure above and below said piston including tubular exhaust means relatively slidable in said lower passage; and a choke orifice in said piston between said upper and lower passages to restrict flow of fluid therethrough from said upper passage to said lower passage.

13. Percussion drilling apparatus: comprising a housing structure connectible to a drill string; an anvil in the lower portion of said housing structure and operatively connectible to a drill bit; a hammer piston reciprocable in said housing structure for intermittently impacting against said anvil, said piston having an upper passage and a lower passage; tubular inlet means relatively slidable in said upper passage for directing a fluid medium under pressure into said upper passage; first means for directing the fluid medium from said upper passage into said housing structure above said piston upon upward movement of said piston in said housing structure for driving said piston downwardly toward said anvil; second means for directing the fluid medium from said upper passage into said housing structure below said piston upon downward movement of said piston in said housing structure for elevating said piston in said housing structure; means for alternately exhausting the fluid medium from the housing structure above and below said piston including tubular exhaust means relatively slidable in said lower passage; and a choke orifice in said piston between said upper and lower passages to restrict flow of fluid therethrough from said upper passage to said lower passage; said exhausting means further including a side port in said piston below and adjacent to said choke orifice establishing fluid communication between the exterior of said piston and said lower passage.

* * * * *